US009260218B2

(12) United States Patent
Lundius

(10) Patent No.: US 9,260,218 B2
(45) Date of Patent: Feb. 16, 2016

(54) PALLET

(71) Applicant: Crossborder Technologies AB, Trelleborg (SE)

(72) Inventor: Christer Lundius, Trelleborg (SE)

(73) Assignee: Crossborder Technologies AB, Trelleborg (SE)

( * ) Notice: Subject to any disclaimer, the term of this patent is extended or adjusted under 35 U.S.C. 154(b) by 0 days.

(21) Appl. No.: 14/364,063

(22) PCT Filed: Dec. 7, 2012

(86) PCT No.: PCT/SE2012/051357
§ 371 (c)(1),
(2) Date: Jun. 9, 2014

(87) PCT Pub. No.: WO2013/085461
PCT Pub. Date: Jun. 13, 2013

(65) Prior Publication Data

US 2014/0345501 A1 Nov. 27, 2014

(30) Foreign Application Priority Data

Dec. 9, 2011 (SE) ..... 1151176-3
May 21, 2012 (SE) ..... 1200308-3

(51) Int. Cl.
*B65D 19/00* (2006.01)
*B65D 19/40* (2006.01)

(52) U.S. Cl.
CPC ..... *B65D 19/40* (2013.01); *B65D 19/0095* (2013.01); *B65D 2519/00024* (2013.01);
(Continued)

(58) Field of Classification Search
CPC .. B65D 19/00; B65D 19/002; B65D 19/0026; B65D 19/0095; B65D 19/40
USPC ..... 108/52.1, 56.1, 56.3, 57.17, 55.1
See application file for complete search history.

(56) References Cited

U.S. PATENT DOCUMENTS 4,292,899 A * 10/1981 Steffen ..... 108/51.11
5,402,735 A * 4/1995 DeJean ..... 108/57.17
(Continued)

FOREIGN PATENT DOCUMENTS

DE 296 07 852.2 U1 8/1996
FR 2.124.441 A1 9/1972
(Continued)

OTHER PUBLICATIONS

International Search Report mailed Mar. 26, 2013, issued in corresponding International Application No. PCT/SE2012/051357, filed Dec. 7, 2012, 7 pages.
(Continued)

*Primary Examiner* — Daniel Rohrhoff
(74) *Attorney, Agent, or Firm* — Christensen O'Connor Johnson Kindness PLLC

(57) ABSTRACT

The present invention relates to a pallet comprising at least two stringers in the form of elongate main profiles 10 which extend along a longitudinal direction L, are connected to each other and are located at a distance from each other; the main profiles have a cross section which comprises a bottom 11 and two side surfaces 12*a*, 12*b* extending from the bottom and provided with through-openings through both side surfaces 12*a*, 12*b* in order to form a channel that permits introduction of a fork. In one embodiment, the pallet comprises at least one elongate stiffening profile 20 extending above and past said opening on both sides. The pallet may comprise a load-transferring end element, which at least partially covers an end of one of the main profiles, a load-transferring stiffening element that extends in direct proximity to and along a vertically extending edge of one of the openings and a filler profile which extends along the underside of the load deck.

14 Claims, 7 Drawing Sheets

(52) U.S. Cl.
CPC ..... *B65D2519/00034* (2013.01); *B65D 2519/00059* (2013.01); *B65D 2519/00069* (2013.01); *B65D 2519/00129* (2013.01); *B65D 2519/00139* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00412* (2013.01); *B65D 2519/00432* (2013.01); *B65D 2519/00572* (2013.01)

(56) References Cited

U.S. PATENT DOCUMENTS

| | | | | |
|---|---|---|---|---|
| 5,809,902 | A * | 9/1998 | Zetterberg | 108/51.11 |
| 8,316,780 | B2 * | 11/2012 | Ng | 108/56.1 |
| 2008/0202391 | A1 | 8/2008 | Pisano | |
| 2009/0101049 | A1 * | 4/2009 | Lee | 108/57.32 |
| 2013/0032064 | A1 * | 2/2013 | Randall et al. | 108/50.11 |
| 2013/0298806 | A1 * | 11/2013 | Johnson et al. | 108/56.1 |

FOREIGN PATENT DOCUMENTS

| | | | |
|---|---|---|---|
| GB | 678586 | A | 9/1952 |
| JP | 10-59360 | A | 3/1998 |
| WO | 86/00866 | A1 | 2/1986 |
| WO | 2005/037667 | A1 | 4/2005 |
| WO | 2007/141154 | A1 | 12/2007 |
| WO | 2008/002007 | A1 | 1/2008 |
| WO | 2008/054325 | A1 | 5/2008 |
| WO | 2009/053698 | A1 | 4/2009 |

OTHER PUBLICATIONS

Supplementary European Search Report and Written Opinion mailed Jul. 10, 2015, issued in corresponding European Application No. 12 85 6272.5, filed Dec. 7, 2012, 9 pages.

* cited by examiner

PALLET

TECHNICAL FIELD

The present invention relates to a pallet.

According to a first aspect, the invention relates to a pallet comprising at least two stringers in the form of elongate main profiles which extend along a longitudinal direction, are connected to each other and are located at a distance from each other in a transverse direction, wherein the longitudinal direction and the transverse direction define a horizontal plane, wherein each main profile has a cross section which comprises a bottom and two side surfaces extending from the bottom, wherein the main profiles are oriented such that the side surfaces extend substantially upwards from the bottom, substantially along a vertical direction which is perpendicular to the horizontal plane, wherein the main profiles are each provided with through-openings through both side surfaces in order to form a channel which extends through said at least two main profiles and permits introduction of a fork, and wherein each opening has an extent in the longitudinal direction and an extent in the vertical direction.

According to a second aspect, the invention relates to a pallet comprising at least two stringers in the form of elongate main profiles which extend along a longitudinal direction, are connected to each other and are located at a distance from each other in a transverse direction, wherein the longitudinal direction and the transverse direction define a horizontal plane, wherein the main profiles have a cross section which comprises a bottom and two side surfaces extending from the bottom, and wherein the main profiles are oriented such that the side surfaces extend substantially upwards from the bottom, substantially along a vertical direction which is perpendicular to the horizontal plane.

According to a third aspect, the invention relates to a pallet comprising at least two stringers in the form of elongate main profiles which extend along a longitudinal direction, are connected to each other and are located at a distance from each other in a transverse direction, wherein the longitudinal direction and the transverse direction define a horizontal plane, wherein the main profiles have a cross section which comprises a bottom and two side surfaces extending from the bottom, wherein the main profiles are oriented such that the side surfaces extend substantially upwards from the bottom, substantially along a vertical direction which is perpendicular to the horizontal plane, wherein the main profiles are each provided with through-openings through both side surfaces in order to form a channel which extends through both main profiles and permits introduction of a fork, and wherein each opening has an extent in the longitudinal direction and in the vertical direction.

According to a fourth aspect, the invention relates to a pallet comprising at least two stringers in the form of elongate main profiles which extend along a longitudinal direction, are connected to each other and are located at a distance from each other in a transverse direction, wherein the longitudinal direction and the transverse direction define a horizontal plane, wherein the main profiles are each provided with through-openings through both side surfaces in order to form a channel which extends through both main profiles and permits introduction of a load-anchoring element, such as a flexible strap, rope, cord or band, intended to run round the pallet and the load arranged on the pallet.

BACKGROUND OF THE INVENTION

Pallets are commonly used in situations where various types of loads are stored or transported. Pallets are available in many different designs. The traditional pallet is made of wood and comprises a load deck on which the load is intended to be placed. To allow the pallet to be lifted, the pallet is provided with two or three parallel stringers on which the load deck rests. The stringers comprise a longitudinal lower board and two or more pallet-deck spacers between said board and the load deck. In this way, a space is formed between the underside of the load deck and the ground, or between the top side of the board and the underside of the load deck, for access by forks of a fork-lift truck or the like. There are pallets of a similar design that are made of plastic or metal.

Pallets not made of wood are becoming more common now. These pallets have advantageous properties such as a longer useful life and less risk of damage and are more hygienic compared to pallets made of wood. For example, these pallets can be made of plastic or metal. However, there are also disadvantages or difficulties in constructing pallets from plastic or metal. For example, when constructing pallets from metal, it is necessary to use relatively thin plate in order to ensure that they are sufficiently light in weight and that they have a reasonable price in relation to their service life. However, a pallet made from thin plate can make handling difficult, since the pallet, compared to a pallet made from thicker plate, is not as durable when handled by trucks, for example. A pallet made from thin plate is quite easily damaged during such handling.

WO 2007/141154 describes a typical pallet made of metal and having a plurality of stringers and a load deck. The stringers are tubular and are formed in one piece with those parts of the load deck that connect the stringers to one another. The side surfaces of the stringers have punched-out openings through which a fork can be introduced in order to lift the pallet.

Depending on how the pallet is intended to be used, it will be exposed to different kinds of loading scenarios. If the pallet is intended to be used in a uniform and well-defined manner, it is possible to construct the pallet for a limited number of loading scenarios. An example of such a use is when the pallet is to be owned by a company that intends to use the pallet in one way or in a limited number of different ways. If the pallet is intended to be used in an open system in which pallets are interchanged, account has to be taken of a large number of different loading scenarios.

A typical loading scenario is one in which a pallet is placed in a pallet stand. A pallet stand in most cases has a front and a rear transverse beam for supporting the pallet. If a heavy load is placed on a pallet positioned in a pallet stand, the pallet tends to bend downwards between the transverse beams. This downward bending can lead to permanent deformations or, in the worst case, to the pallet breaking and falling from the pallet stand.

Another typical loading scenario is when pallets are stacked on top of one another. When stacking pallets, a superstructure is almost always used that generally comprises one or more pallet collars placed on top of one another. The upper pallet is placed such that it is supported by the superstructure. If a pallet with U-shaped stringers (as are common in a pallet made of metal) is stacked with a heavy load, the sides of the stringers (the legs of the U-profile) bend outwards.

Similar deformation also arises when a pallet with U-shaped stringers (as are common in a pallet made of metal) stands on the ground and is loaded with a heavy load.

Another typical loading scenario is when the pallet is loaded with an uneven or unbalanced load. This can lead to uneven loading of the pallet, which in turn can cause the central part of the stringers to sag. Stacking a pallet on top of a pallet with an uneven load can create deformation of this kind even at relatively low loads.

It may thus be said that there is a need for a pallet with improved load resistance in at least one of the described loading scenarios.

In addition, it is important that the pallet is sufficiently resistant to collisions and impacts, which it can be exposed to from trucks or other equipment used for lifting and moving pallets.

SUMMARY OF THE INVENTION

A general object of the present invention is therefore to make available a pallet which has improved load resistance in at least one of the loading scenarios described above.

According to a first aspect, it is an object of the present invention to make available a pallet which can be loaded with a high load and can be arranged in a pallet stand without being deformed.

According to a second aspect, it is an object of the present invention to make available a pallet which can be loaded with a high load and can stand on the ground without being deformed on the side surfaces of the stringers.

According to a third aspect, it is an object of the present invention to make available a pallet which can be stacked without suffering deformations in the side surfaces of the stringers.

According to a fourth aspect, it is an object of the present invention to make available a pallet which can be loaded with an uneven and unbalanced load without suffering deformations in the stringers of the pallet.

According to a first aspect of the present invention, said pallet comprises at least two stringers in the form of elongate main profiles which extend along a longitudinal direction, which are connected to each other and which are located at a distance from each other in a transverse direction, wherein the longitudinal direction and the transverse direction define a horizontal plane, wherein each main profile has a cross section which comprises a bottom and two side surfaces extending from the bottom, wherein the main profiles are oriented such that the side surfaces extend substantially upwards from the bottom, substantially along a vertical direction which is perpendicular to the horizontal plane, wherein the main profiles are each provided with through-openings through both side surfaces, wherein each opening has an extent in the longitudinal direction and an extent in the vertical direction, and wherein said openings are arranged at corresponding same positions on all of the side surfaces so that at least one channel which extends through said at least two main profiles is created in order to permit introduction of a fork, The pallet is characterized in that it further comprises at least one elongate stiffening profile extending along the longitudinal direction, that said at least one stiffening profile is in each case secured in one of the side surfaces of a respective main profile, that said at least one stiffening profile extends in each case, in view of the longitudinal direction, across the extent of at least one opening in the longitudinal direction and past said at least one opening on both sides of said at least one opening, and that each stiffening profile is arranged, in view of the vertical direction, above the channel.

The stiffening profile stiffens the main profile and thus increases the load resistance when the pallet is arranged in a pallet stand. The vertical loading of the pallet is transferred to the transverse beams of the pallet stand at two locations (one at the front and one at the rear in the longitudinal direction) at outer parts of the main profiles in the longitudinal direction. It has been found that relatively thin plate which is used to produce metal pallets will buckle when exposed to compressive forces. When the pallet is placed in the pallet stand, the lower part of the U-profile will be exposed to tensile forces and the upper part of the U-profile will be exposed to compressive forces. It has also been found that the worst exposed points are corners at the openings for forming channels. Since the stiffening profiles are allowed to extend past at least one opening, on both sides of said at least one opening, and since each stiffening profile is arranged in the vertical direction above the channel, this has the effect that the bottom, the side surfaces and the stiffening profile together constitute a stiff cage structure with high flexural strength against bending around a flexion axis in the transverse direction. The total load resistance of the pallet thus increases, especially when the pallet is intended to be arranged in a pallet stand.

A further advantage obtained when the stiffening profiles are arranged in the vertical direction above the channel is that the forks of the fork-lift truck come in contact with a strong and stiff structure when the pallet is to be lifted.

A further advantage of the stiffening profiles is that the pallet, in particular the side surfaces thereof, are more resistant to collision. The stiffness that the stiffening profile confers on the side surfaces means that, when a fork strikes the side surface, much greater force is needed to deform the surface than is the case with a pallet without a stiffening profile.

Preferred embodiments are set forth in the dependent claims.

The main profile can comprise a single piece constituting the bottom and the side surfaces. The side surfaces can be folded from the bottom in such an embodiment.

Alternatively, the side surfaces can be made completely or partially from separate parts, which are secured in the bottom or in sides folded from the bottom.

The main profile can also have a top surface. The top surface can be arranged opposite the bottom and substantially horizontally. The top surface can be secured to one or both side surfaces. The top surface can also be formed by one or more stiffening profiles.

Each stiffening profile preferably has, in the vertical direction, a lower contact surface facing the channel. This property provides a contact surface for a fork, for example. Therefore, the pallet can also be lifted by means of a fork inserted in the transverse direction, and not only by means of a fork inserted in the longitudinal direction between the main profiles.

Preferably, each stiffening profile partially covers each opening. This design provides further resistance to collision.

The openings can be open upwards in the vertical direction. This property simplifies the production of the main profiles and in addition reduces weight. A further advantage of this design is that the side surfaces cope with greater downward bending without the side surfaces being permanently deformed, which would be able to happen, for example, by parts of the side surface being folded. A permanent deformation can give the impression that the pallet is broken, even though the pallet is still serviceable. A false impression of this kind can be avoided when the openings are open upwards in the vertical direction. Folding of the side surface can also lead to the pallet catching in adjacent pallets or can cause a user to injure himself on the folded plate edge.

The openings are advantageously aligned. This property creates a straight channel for passage of a fork.

The bottom of at least one of the main profiles preferably has a substantially triangular indent. The indent creates stiffness in the bottom of the main profile. Together with one or more stiffening profiles, the fold ensures that the main profile has a uniform stiffness in the vertical direction. The bottom thus has substantially the same stiffness as the side surfaces with the stiffening profiles.

The pallet preferably comprises a stiffening profile arranged on each side surface of each main profile. The pallet thus comprises one stiffening profile per side surface. This ensures good and uniform stiffening of the pallet.

The stiffening profiles preferably have a substantially C-shaped cross section. The stiffening profile then creates an upper surface on which a load from the load deck of the pallet can be distributed. This can provide more uniform load distribution across the main profiles and thereby increase the load quantity that the pallet can carry without the main profiles deforming. A C-shaped cross section also means that the stiffening profiles themselves have a high degree of stiffness. This property in turn provides considerable stiffening of the main profiles. In addition, the C-profile can, if so desired, be oriented such that it forms a lower surface that can suitably be used as a support surface when the pallet is to be lifted by a fork-lift truck or the like.

A further advantage of a C-shaped profile is that it confers a high degree of collision resistance on the pallet, especially on the side surfaces thereof.

Alternatively, one or more of the stiffening profiles of the pallet can have a substantially Z-shaped cross section. The Z-profile can be arranged such that an upper surface of the profile extends in the transverse direction out from one side surface of the main profile. Just like a C-shaped stiffening profile, the Z-profile can, if so desired, be oriented such that it forms a lower surface that can suitably be used as a support surface when the pallet is to be lifted by a fork-lift truck or the like.

The Z-profile is preferably arranged on a side surface that does not form an outer surface of the pallet in the transverse direction. In this way, there is no risk of a projecting edge of the stiffening profile causing injury or damage to persons or machines handling the pallet.

As has been mentioned above, the stiffening profile can form a top surface of the main profile. Such a stiffening profile can be formed like a staple, that is to say with a horizontal top surface, two side surfaces extending in the vertical direction from the top surface, and two substantially horizontal lower surfaces that extend inwards from the side surfaces. The stiffening profile with such a design can be oriented such that the top surface runs along a part of the upwardly open end of the main profile and such that the side surfaces of the stiffening profile are then arranged on side surfaces of the main profile. The lower surfaces of the stiffening profile then form a lower surface that can suitably be used as a support surface when the pallet is to be lifted by a fork-lift truck or the like.

The number of main profiles is preferably at least three. This property creates a larger load-transferring surface, which permits a greater loading capacity of the pallet.

The pallet can further comprise a substantially horizontal load deck. The load deck is preferably arranged in direct or indirect contact with the main profiles and above the latter in the vertical direction.

Preferably, each main profile has such a design that a longitudinal tunnel inside the main profile has a height of 85 to 160 mm.

Preferably, at least the main profiles of the pallet are made of metal, in particular of high-strength thin plate. In one embodiment in which the bottom and side surfaces of each main profile are formed in one piece, the edges between the bottom and each side surface can be produced by bending a surface made of metal.

According to a second aspect of the present invention, the pallet comprises at least two stringers in the form of elongate main profiles which extend along a longitudinal direction, which are connected to each other and which are located at a distance from each other in a transverse direction, wherein the longitudinal direction and the transverse direction define a horizontal plane, wherein the main profiles have a cross section which comprises a bottom and two side surfaces extending from the bottom, and wherein the main profiles are oriented such that the side surfaces extend substantially upwards from the bottom, substantially along a vertical direction which is perpendicular to the horizontal plane, The pallet is characterized in that the pallet further comprises a load-transferring end element, that the end element has a surface which at least partially covers an end, open in view of the longitudinal direction, of one of the main profiles, that the end element has at least two vertically extending stiffening folds arranged at a distance from one another in the transverse direction, that the end element has an upper surface that extends in the longitudinal direction inwards from the surface and towards said one of the main profiles, and that the end element has a vertical extent such that the end element may transfer a vertical load from the upper surface of the end element to the bottom of the main profile or to the support on which the pallet is designed to be placed.

By that the upper surface extends inwards from the surface, is meant that the upper surface extends towards the main profile at which the end element is arranged.

Since the end element at least partially covers a longitudinally open end of one of the main profiles and since the end element has a vertical extent such that the end element can transfer a load from the upper surface to the bottom of the main profile or to the support, two desirable functions are obtained: firstly, there is less risk of the forks of the truck becoming caught, and, secondly, an additional load-bearing element is obtained for taking up vertical loads. By means of the stiffening folds, stiffening is also obtained in respect of the ability of the end element to support vertical loads.

The end element has an extent in the vertical direction such that the end element may transfer a load from its upper surface to its lower surface. By this is meant that the end element is formed such that it may receive a vertical load at its upper surface, transfer the vertical load in the vertical direction and through the end element, to its lower surface. The upper surface of the end element is preferably directly or indirectly connected to the load deck of the pallet. By this feature, the end element may receive and transfer vertical loads from the load deck and any load to be arranged thereon. The lower surface of the end element is preferably directly or indirectly connected either to the bottom of the main profile at which the end element is arranged, or to the support on which the pallet is arranged. The support may e.g. be an underlying pallet or the ground.

The load transfer achieved by means of the end element leads to the side surfaces of the main profiles being subjected to less loading. The vertical load, typically deriving substantially from the load applied on the load deck, which the main profiles without any end elements would be subjected to, are instead received by the one or two end elements of the main profile and transferred to the bottom of the main profile or the support on which the pallet is arranged. This property means in turn that the pallet may be loaded with a heavier load without the side surfaces of the main profiles sagging, compared to a pallet without an end element.

When the pallet is surmounted by a pallet collar, the corners of the pallet are exposed to great vertical loads from the pallet collar. These vertical loads are transferred from the pallet collar to the upper surface, through the end element and onwards down to the bottom of the main profile or the support on which the pallet is designed to be placed. By means of this load transfer, the side surfaces of the main profiles are subjected to less loading. This has the effect that the pallet with a pallet collar can be loaded with a greater load without the side surfaces of the main profiles sagging or being otherwise deformed, compared to a pallet without an end element.

The pallet can further comprise a corner-stiffening element which extends substantially in the horizontal plane and which has an extent such that the corner-stiffening element covers a part of the extent of the upper surface of the end element. Preferably, the corner-stiffening element covers the greater part of the extent of the upper surface of the end element.

From the corner-stiffening element, a vertical load can be transferred through a contact surface with the upper surface of the end element. The vertical load can be a load which is arranged on a load deck of the pallet and/or a load which stems from a superstructure and a further pallet placed on the superstructure. The corner-stiffening element reduces the risk of the load impacting the upper surface too far out on the upper surface such that the load folds the upper surface downwards without transferring any appreciable vertical load to the vertical extent of the end element.

The corner-stiffening element can have an extent such that it covers the greater part of the extent of the upper surface in the longitudinal direction and onwards beyond the upper surface in the longitudinal direction and/or transverse direction.

A design in which the corner-stiffening element extends beyond the extent of the upper surface ensures safe transfer of the load from the superstructure or load deck to the end element. The corner-stiffening element can extend beyond the extent of the upper surface in the longitudinal direction and/or in the transverse direction. The fact that the corner-stiffening element extends onwards beyond the upper surface provides greater stiffening.

A larger surface on the corner-stiffening element provides broader load distribution and evens out the distribution of point loads. The total loading of the pallet can then be increased.

The corner-stiffening element is preferably secured in the upper surface. This property permits a load transfer even for loads directed in the longitudinal direction.

The corner-stiffening element can be formed by part of a frame. The frame preferably runs round a load deck of the pallet. The frame is advantageously closed such that it runs round the whole load deck of the pallet. According to a preferred embodiment, the frame is formed by four frame elements which each extend along one of the four sides of the pallet. The frame elements are secured to one another at the corners. Each frame element can be formed by one or more elongate profiles.

The frame element can comprise a groove which runs along the edge. The groove can be arranged, for example, to permit arrangement of a pallet collar or another form of superstructure. Therefore, no external add-on part is needed, sometimes called a stop edge, which is commonly used to permit arrangement of a pallet collar. The frame element with groove replaces this external add-on part.

Alternatively, a pallet collar can be arranged in direct contact with the upper surface of the end elements. In this embodiment, a vertical load is transferred from the pallet collar directly to the upper surface and onwards down through the end element.

At least one of the at least two folds in the surface can limit the extent of the surface in the transverse direction. In this embodiment, the end element has at least one side surface.

Said at least one fold constitutes the corner between the surface and said at least one side surface. According to a preferred embodiment, the end element is provided with two side surfaces which are each intended to extend inwards along a respective side surface of the main profile. In this way, the end element is provided with at least two vertically extending folds. Advantageously, the side surfaces of the end element are secured on the side surfaces of the main profile. The securing can be done by riveting, for example.

Each side surface of the end element can be formed by a side tongue. Alternatively, each side surface and the upper surface can together form an inwardly directed surface.

The at least two folds in the surface can also be designed as at least one impression, either as an alternative or as a complement to the side surface folds. The impression can project inwards in the longitudinal direction towards the main profile or outwards from the main profile. Preferably, the impression is arranged inwards in the longitudinal direction. In this way, the length of the pallet is not increased by the impression, and the pallet is not provided with any projecting part that can catch in other pallets, superstructures, loads or the like.

The upper surface of the end element is preferably substantially horizontal. This property permits a large contact surface with a horizontal corner-stiffening element or a horizontal load deck of the pallet. In this way, the upper surface creates a large load-distributing surface through the contact surface.

The pallet can further comprise a lower surface. The surface can be formed by a lower tongue which is folded inwards from the surface in the longitudinal direction towards the main profile. Alternatively, the lower surface can be contiguous with the side surfaces and/or the upper surface of the end element.

In one embodiment, the end element is provided with side surfaces and a lower surface which, together with the upper surface of the end element, constitute a contiguous side edge extending inwards from the surface in the longitudinal direction. This can be achieved, for example, if the end element is shaped like a cup with an upper surface, lower surface and side surfaces that extend from the vertical end surface. Such a cup can be produced, for example, by deep drawing.

The lower surface is preferably arranged between the bottom of the main profile and the support on which the pallet is designed to be placed.

The upper surface is advantageously arranged in the vertical direction above the main profile. This ensures safe transfer of a load from, for example, a pallet collar or a corner-stiffening element to the end element without too great a load being transferred via the side surfaces of the main profile before the load begins to be transferred via the end element.

Alternatively, a corner-stiffening element can be provided with or designed with a downwardly projecting portion that extends down between the side surfaces of the main profile to come into contact with the upper tongue. Alternatively, the upper surface of the end element can be provided with or designed with an upwardly projecting portion that extends upwards from the tongue to bear on the corner-stiffening element.

The surface of the end element can preferably completely cover the longitudinally open end of the main profile on which the end element is arranged. This property means that the pallet can be moved by pushing against the surface. A completely covering surface also provides greater stiffness of the end element.

According to a third aspect of the present invention, at least two stringers in the form of elongate main profiles which extend along a longitudinal direction, which are connected to each other and which are located at a distance from each other in a transverse direction, wherein the longitudinal direction and the transverse direction define a horizontal plane, wherein the main profiles have a cross section which comprises a bottom and two side surfaces extending from the bottom, wherein the main profiles are oriented such that the side surfaces extend substantially upwards from the bottom, substantially along a vertical direction which is perpendicular to the horizontal plane, wherein the main profiles are each provided with through-openings through both side surfaces, wherein each opening has an extent in the longitudinal direction and in the vertical direction, and wherein said openings are arranged at corresponding same positions on all of the side surfaces so that at least one channel which extends through said at least two main profiles is created in order to permit introduction of a fork, The pallet is characterized in that the pallet further comprises a load-transferring stiffening element, that the load-transferring stiffening element has at least one vertically extending stiffening fold, that the stiffening fold extends in direct proximity to and along a vertically extending edge of one of the openings, and that the stiffening element in view of the vertical direction is connected directly or indirectly to a horizontal load deck and that the stiffening element is connected directly or indirectly to the bottom of the main profile, such that the stiffening element may transfer a vertical load directly or indirectly from the horizontal load deck directly or indirectly to the bottom of the main profile.

The stiffening element in this embodiment provides an increased load resistance of the pallet when an uneven or unbalanced load is placed on the pallet. The stiffening element stiffens the parts of the side surfaces around the openings in the main profile. The load applied to the central part of the main profile as seen in the longitudinal direction is guided down through the stiffening element directly or indirectly to the bottom of the main profiles. By means of the stiffening element, the side surface of the main profile is subjected to less loading. The pallet can thus withstand a more uneven and unbalanced load without the side surface deforming.

The stiffening element preferably has at least two stiffening folds, particularly preferably at least three stiffening folds. Preferably, at least two of the stiffening folds are separate in the transverse direction. Preferably, at least two of the stiffening folds are separate in the longitudinal direction.

The stiffening element comprises at least two surfaces, preferably at least three surfaces, and particularly preferably at least four surfaces.

Preferably, at least two of the surfaces that do not adjoin each other are arranged parallel to each other. Preferably, the surfaces arranged parallel to each other are arranged in the longitudinal direction.

The stiffening element can be secured in said vertically extending edge of one of the openings. The securing can be provided by means of at least one securing member which is placed through the parallel surfaces of the stiffening element and onwards through the edge. The parallel surfaces preferably extend on a respective side of the edge as seen in the transverse direction.

According to a fourth aspect, the pallet comprises at least two stringers in the form of elongate main profiles which extend along a longitudinal direction, which are connected to each other and which are located at a distance from each other in a transverse direction, wherein the longitudinal direction and the transverse direction define a horizontal plane, wherein the main profiles are each provided with through-openings through both side surfaces, wherein said openings are arranged at corresponding same positions on all of the side surfaces so that at least one channel which extends through said at least two main profiles is created in order to permit introduction of a load anchoring element, such as a flexible strap, a rope, a cord or a band, intended to run round the pallet and the load arranged on the pallet, and wherein each opening has an, in view of a vertical direction, upper geometric limit which, in view of the vertical direction, is situated below and at a distance from an underside of a load deck of the pallet, The pallet is characterized in that the pallet further comprises a filler profile which extends along the underside of the load deck, that the filler profile extends along the channel and, in the transverse direction, has an extent that substantially extends between the main profiles, and that the filler profile has, in the vertical direction, an extent substantially corresponding to the distance between the underside of the load deck and the upper geometric limit of each opening.

An example of when this situation arises is if the main profiles are provided with longitudinal stiffening profiles. The longitudinal stiffening profiles will most probably then extend along the underside of the load deck of the pallet. Since it is desirable that the stiffening profiles extend in the longitudinal direction beyond the openings, a component comes to be present that forces the upper geometric limit of the openings downwards from the underside of the load deck. The geometric limit can be a cut edge, a folded-in edge or another component that extends along the opening. For example, the upper geometric limit can be a longitudinal stiffening profile that extends beyond the opening. If a load-anchoring element such as a tightening strap or the like is inserted through the channel and round the load on the pallet, there comes to be a space between the tightening strap and the underside of the load deck. If a fork of a fork-lift truck is inserted, there is a risk of the fork catching in the strap during insertion. If one succeeds in inserting the fork and then proceeds with lifting, the strap will be lifted and not the underside of the pallet, which can cause the strap to rupture or cause the strap to pull part the load on the pallet.

This problem has been solved, in accordance with the invention, by virtue of the fact that the pallet further comprises a filler profile which extends along the underside of the load deck, the filler profile extends along the channel and, in the transverse direction, has an extent that substantially extends between the main profiles, and the filler profile has, in the vertical direction, an extent substantially corresponding to the distance between the underside of the load deck and the upper geometric limit of each opening. The filler profile comes to constitute a distance between the strap and the underside of the load deck, which means that the lifting force is applied to the filler profile and therefore to the load deck. The strap will simply be clamped between the fork and the filler profile and will not be stretched in order to take up any load during lifting of the pallet.

The filler profile has an extent which, in the transverse direction, extends substantially between the main profiles. It does not have to extend across the whole extent. It is enough that it has an extent in the transverse direction that is sufficiently great to ensure that the distances in the transverse direction between the main profiles and the filler profiles will be much less than the width of the forks. This ensures that there is no risk of the forks catching in any space between the filler profiles and the main profiles.

The main profiles preferably have a cross section which comprises a bottom and two side surfaces extending from the bottom, wherein the main profiles are oriented such that the side surfaces extend substantially upwards from the bottom, substantially along a vertical direction which is perpendicular to the horizontal plane, wherein each opening has an extent in the longitudinal direction and in the vertical direction, and wherein the pallet further comprises at least one elongate stiffening profile extending along the longitudinal direction.

The stiffening profile is advantageously of the type described above and is advantageously oriented and placed in accordance with the preferred embodiments that have been described above in connection with the first aspect of the invention.

According to a preferred embodiment, the pallet is provided with three longitudinal main profiles, namely two outer ones and a central one, in which case the filler profile extends across from one of the outer main profiles to the other of the outer main profiles. In this way, the pallet can be stiffened with respect to flexion in the transverse direction.

In such a variant, it is advantageous if the filler profile is provided with a central opening, such that it can bridge any stiffening profiles of the central main profile. The central opening is advantageously open towards the underside of the load deck of the pallet, with the result that, at a distance from the underside of the load deck, there is a continuous transverse extent of the filler profile which bridges any stiffening profiles of the central main profile.

The filler profile is advantageously designed as a U-profile which, seen in cross section, is provided with substantially horizontal flanges extending outwards from the ends of the side surfaces. The filler profile can be secured to the underside of the load deck of the pallet by, for example, riveting the flanges to the underside of the load deck.

The filler profile is also advantageously provided with a groove which extends along the filler profile and which, in the cross section of the filler profile, is designed as an impression in a central part of the bottom of the U-profile, in the same direction as the side surfaces extends. This means that the U-profile is made stiffer, and the groove also comes to guide and protect the flexible load-anchoring element.

BRIEF DESCRIPTION OF THE DRAWINGS

The invention is described in more detail below with reference to the accompanying schematic drawings which, for the purposes of illustration, show presently preferred embodiments of the invention in accordance with the various aspects of the latter.

DESCRIPTION OF PREFERRED EMBODIMENTS OF THE INVENTION

Figure 1:
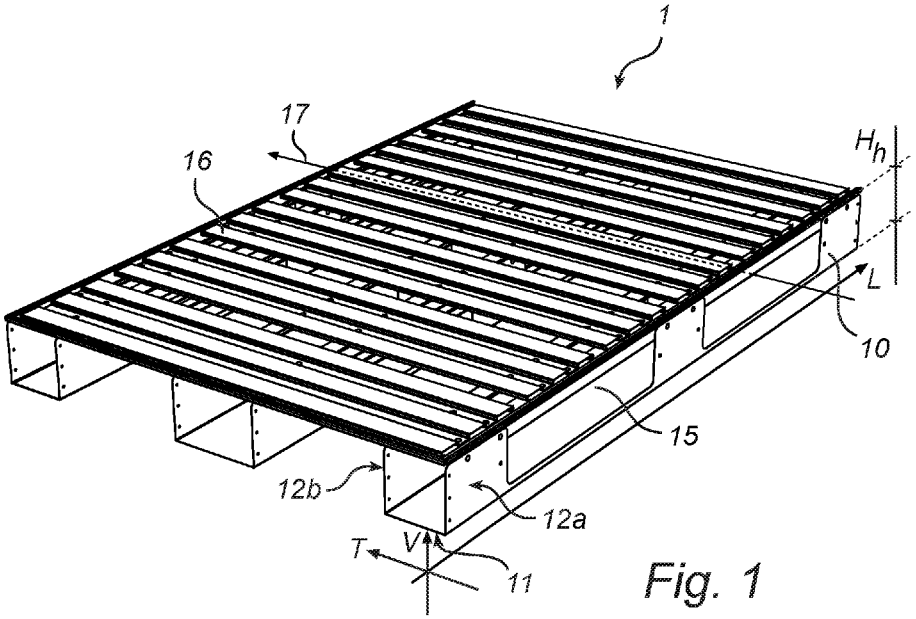
FIG. 1 illustrates a pallet with three main profiles that constitute the stringers of the pallet.

A pallet 1 with three stringers and a load deck is illustrated in FIG. 1. Each stringer comprises an elongate main profile 10 which extends in a longitudinal direction L. The main profiles are arranged at a distance from one another in a transverse direction T. The longitudinal direction L and the transverse direction T define a horizontal plane. A fork, for example of a fork-lift truck, can be inserted through the space formed between each main profile 10 in order to lift the pallet 1.

The main profile 10 comprises a bottom 11 and two side surfaces 12*a*, 12*b*. The side surfaces 12*a*, 12*b* extend upwards from the bottom 11 substantially along a vertical direction V. The vertical direction V is perpendicular to the horizontal plane defined by the longitudinal direction L and the transverse direction T. The bottom 11 and the side surfaces 12*a*, 12*b* together form a substantially U-shaped cross section for the main profile 10.

In this embodiment, the bottom 11 and the side surfaces 12*a*, 12*b* are formed in one contiguous piece. This can be achieved by bending a surface, with the side surfaces 12*a*, 12*b* being folded up from the bottom 11. In an alternative embodiment of the main profile 10, the side surfaces 12*a*, 12*b* are formed entirely or partially of surfaces that are not contiguous with the bottom 11. Instead, the surfaces are secured to the bottom 11 or to surfaces extending from the bottom 11.

Each main profile 10 is provided with through-openings 15. It is advantageous that the number of openings 15 is at least two. The openings 15 are aligned with each other so as to create at least one but preferably at least two channels 17. Each channel 17 extends through the respective main profile 10. Each channel 17 extends mainly in the transverse direction T. Each channel 17 is defined by the geometrical boundaries of the openings 15, i.e. the edges in the side surface which define the opening 15 in that side surface.

By that the openings 15 being aligned is meant that the openings 15 are arranged at corresponding same positions on all the side surfaces in the main profiles 10, such that a longitudinal straight channel 17 through the main profiles 10 is created. It is to be understood that the openings 15 do not need to be completely aligned, such that they overlap each other completely in view of the created channel 17 direction. The openings 15 could be arranged with a displacement in view of each other, as long as at least a part of each opening is aligned with the rest of the openings such that the straight channel 17 is created.

The channel 17 should permit introduction of a fork of standard shape belonging, for example, to a fork-lift truck. The fork can be inserted through the preferably two channels 17 in order to lift the pallet 1 from the side. In this way, the pallet 1 can be lifted by insertion of a fork in the longitudinal direction between the main profiles 10 or by insertion of a fork in the transverse direction through the channels 17.

As has been mentioned, the openings 15 are in alignment. This means that the openings are arranged at the corresponding and same locations on all the side surfaces 12*a*, 12*b* of each main profile 10 of the pallet 1. This property means that the fork can be easily inserted through the channel 17.

The respective openings 15 have an extent in the longitudinal direction L and an extent in the vertical direction V.

In all the illustrations of the present invention, the openings 15 are open towards the top in the vertical direction. This is a preferred embodiment and provides certain advantages. For example, the openings can be formed by recesses that can be produced by cutting out parts of each side surface 12*a*, 12*b* of the main profile 10. Alternatively, the openings 15 can be intermediate spaces that are formed when one of the side surfaces 12*a*, 12*b* comprises surfaces which are arranged at a distance from each other in the longitudinal direction.

Alternatively, it is possible to use closed openings, that is to say openings that are delimited in both the vertical direction and the longitudinal direction by the side surface 12*a*, 12*b* in which the opening 15 is arranged.

In this preferred embodiment, the pallet 1 is made of metal. Suitable metals are, for example, high-strength thin plate and aluminium. In other embodiments, the pallet 1 is at least partially made of other durable materials, such as hard plastic. In one embodiment, each main profile 10 is made of metal, while other parts of the pallet 1 are made of a material other than metal.

A preferred thickness of at least the side surfaces 12*a*, 12*b* of a main profile 10 made of metal is in the range of 0.4 to 2 millimeters, preferably in the range of 0.8 to 1.5 millimeters. This thickness provides good stiffness of the main profile 10 and at the same time permits low consumption of material. The consumption of material should be kept low with a view to price and weight.

The height $H_h$ in FIG. 1 is the height of the tunnel formed through the main profile 10. It is advantageous that the height of this tunnel is 85 to 160 millimeters. This property is advantageous when, for example, the height $H_h$ of the stringer or of the pallet 1 is measured off in an automated warehouse in order to detect the pallet 1. If the height $H_h$ does not correspond to a predetermined standard value, there is a risk of the pallet 1 not being detected as a pallet that can be handled.

The pallet 1 in accordance with the above can comprise two or more stringers. A greater number of stringers permits a larger load deck and a higher loading capacity.

Figure 2A:
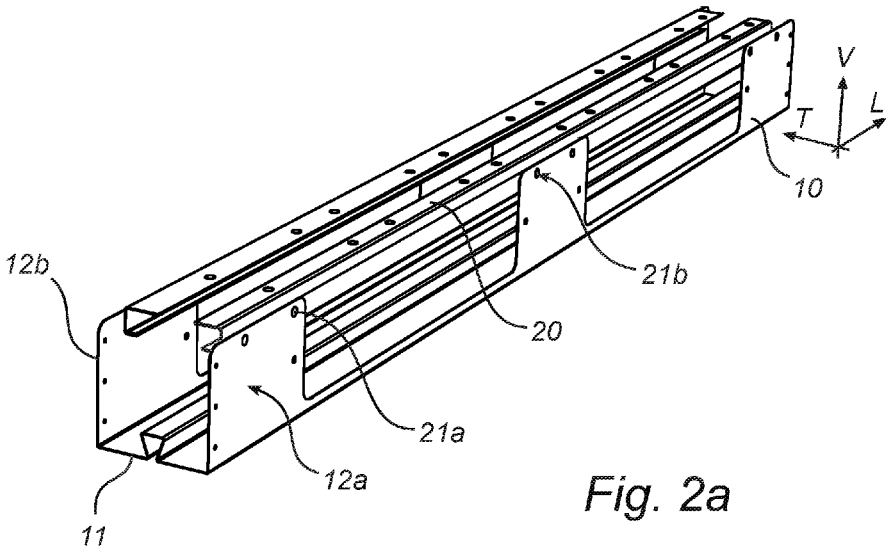
FIG. 2*a* illustrates a main profile with stiffening profiles along side surfaces of the main profile.

In a first embodiment of the present invention, the pallet 1 in accordance with the above comprises a stiffening profile 20. A main profile 10 of the pallet 1 which has a stiffening profile 20 is illustrated in FIG. 2*a*. The stiffening profile 20 is elongate and extends in the longitudinal direction L. The stiffening profile 20 extends along the side surface 12*a* of the main profile 10.

The stiffening profile 20 stiffens the main profile 10, and in particular the side surface 12*a* thereof. The stiffening mainly affects the load resistance in the vertical direction when the pallet 1 is arranged in a pallet stand. In the pallet stand, the load of the pallet 1 is transferred at two different locations at the outer parts of the main profile 10 in the longitudinal direction. By virtue of the stiffening provided by the stiffening profile 20 at those parts of the main profile 10 lying between the ends where the load is transferred, the pallet 1 withstands higher loads.

In this embodiment, the stiffening profile 20 is made of metal. The thickness of the metal from which the stiffening profile 20 is made preferably lies in the range of 0.4 to 2 millimeters, particularly preferably in the range of 0.8 to 1.5 millimeters. This thickness provides good stiffening of the main profile 10, while at the same time the consumption of material during production is low.

The stiffening profile is advantageously a so-called C-profile, i.e. it has a substantially C-shaped cross section with a vertical web and two horizontal flanges arranged at each end of the web and facing in the same direction away from the web. The C-profile has dimensions in accordance with the following range: height of the web: 10 to 30 millimeters; length of the flanges: 5 to 40 millimeters.

The stiffening profile 20 is secured in the side surface 12*a*. It is secured by means of securing members 21*a*, 21*b*. The securing members 21*a*, 21*b* can be in the form of rivets, screws or other suitable members having the same function.

Figure 2B:
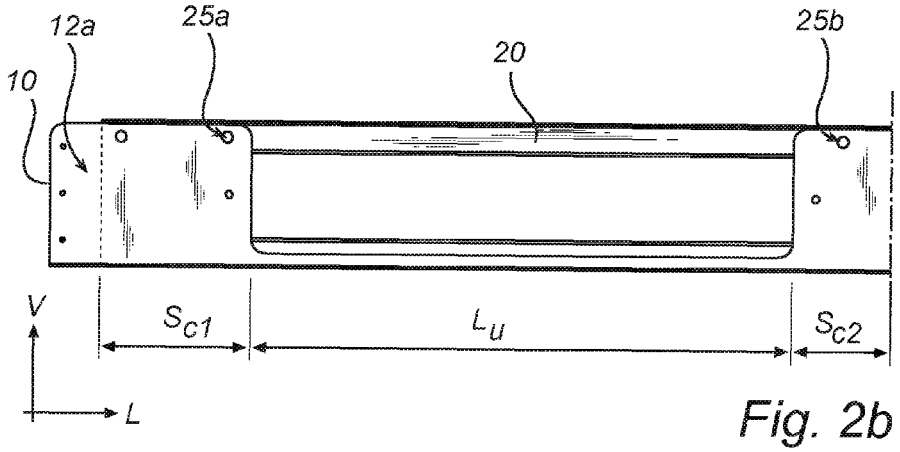
FIG. 2*b* is a side view of the main profile in FIG. 2*a*.

In FIG. 2*a*, stiffening profiles 20 are arranged on each side surface 12*a* and 12*b* of the main profile 10. The stiffening profiles 20 extend across both openings 15 of each side surface 12*a*, 12*b*. FIG. 2*b* is a side view of a main profile 10 which has substantially the same design as the main profile 10 in FIG. 2*a*.

In FIG. 2*b*, the stiffening profile 20 has an extent that comprises the longitudinal direction across the extent $L_u$ of the opening in the longitudinal direction. The extent of the stiffening profile 20 also comprises an extent $S_{c1}$, $S_{c2}$ past the opening, on both sides of the opening. The extent of the stiffening profile 20 is therefore $L_u+S_{c1}+S_{c2}$. By means of the extent $S_{c1}$, $S_{c2}$ of the stiffening profile 20 on both sides of the opening, good stiffening of the main profile 10 is obtained. It will be appreciated that the extent of the stiffening profile 20 to the sides of each opening 15 can be either of the same length or of a different length.

A corresponding stiffening profile 20 is arranged at each opening of the main profile 10. The stiffening profile 20 is arranged above said channel 17 in the vertical direction V.

Figure 2C:
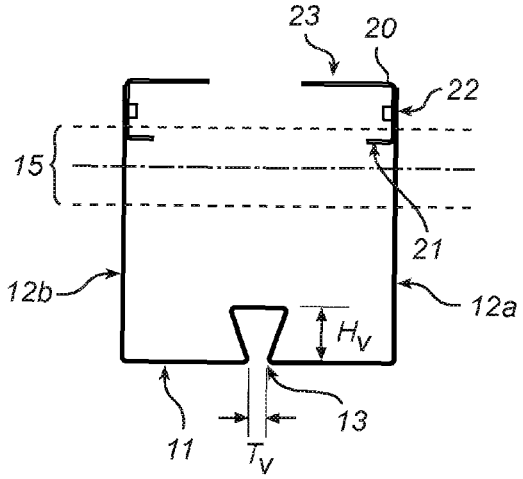
FIG. 2*c* shows a cross section of a main profile with a stiffening profile.

The stiffening profile 20 has a substantially C-shaped cross section, which is illustrated in FIG. 2*c*. FIG. 2*c* shows a cross section of the main profile 10 in FIG. 2*a* or 2*b*.

The stiffening profile 20 comprises a lower surface 21, a side surface 22 and an upper surface 23. Together, they form the substantially C-shaped cross section. The profile provides good stiffening by virtue of its shape. In addition to this property, the surfaces of the profile have other advantageous functions, as will be described below.

By means of the upper surface 23, the load from the load deck 16 can be taken up directly or indirectly. The upper surface 23 increases the surface area receiving the load from the load deck 16. A larger surface means a greater distribution of the weight. This property, together with the stiffening provided by the stiffening profile 20, means that the pallet 1 withstands a greater load without the pallet 1, in particular the main profile 10, being deformed. This advantage is achieved in particular when the pallet 1 is arranged in a pallet stand.

By means of the side surface 22, the stiffening profile 20 can be secured in the side surface 12*a*.

By means of the lower surface 21, a contact surface is obtained. A fork that is driven along an insertion line through the channel 17 formed by the openings 15 can then be rested on the contact surface. When the pallet 1 is lifted by means of the fork, a vertical weight from a load on the load deck 16 can be conveyed through the stiffening profile 20 and taken up by the fork.

The stiffening profile 20 thus functions as a load-transferring element.

An indent 13 is arranged in the bottom 11 of the main profile 10. The indent 13 stiffens the bottom 11. The main profile 10 is thus strengthened and is less unstable. The stiffening of the bottom 11, as provided by the indent 13, is advantageous especially when the pallet is arranged in a pallet stand.

The indent 13 shown in FIG. 2*c* is formed by a substantially triangular projection. The base of the triangle is arranged, in the vertical direction V, furthest away from the bottom 11 of the main profile 10. By means of the indent 13, an opening is formed in the bottom 11. The opening has an extent $T_v$ in the transverse direction T. The opening is an elongate opening that runs along the bottom 11 in the longitudinal direction L. The indent 13 has an extent $H_v$ in the vertical direction V.

It is advantageous if the base is wider than the opening. This provides greater stiffening than in the opposite case.

It is also advantageous if the opening has the shortest possible extent $T_v$ in the transverse direction T. This property reduces the risk of the stringer, i.e. the main profile 10, being detected as defective, for example during scanning in an automated warehouse. In order to further remedy this problem, the pallet 1 can further comprise a sheet (not shown). The sheet is arranged in the vertical direction under the bottom 11 of at least one of the main profiles 10 of the pallet 1. The sheet can be a metal sheet, for example. The sheet is arranged such that it at least partially covers the opening created by the indent 13. The sheet can be made from soft aluminium, for example.

Together with the stiffening profiles 20, the indent 13 creates a main profile with uniform strength in the vertical direction.

Figure 3A:
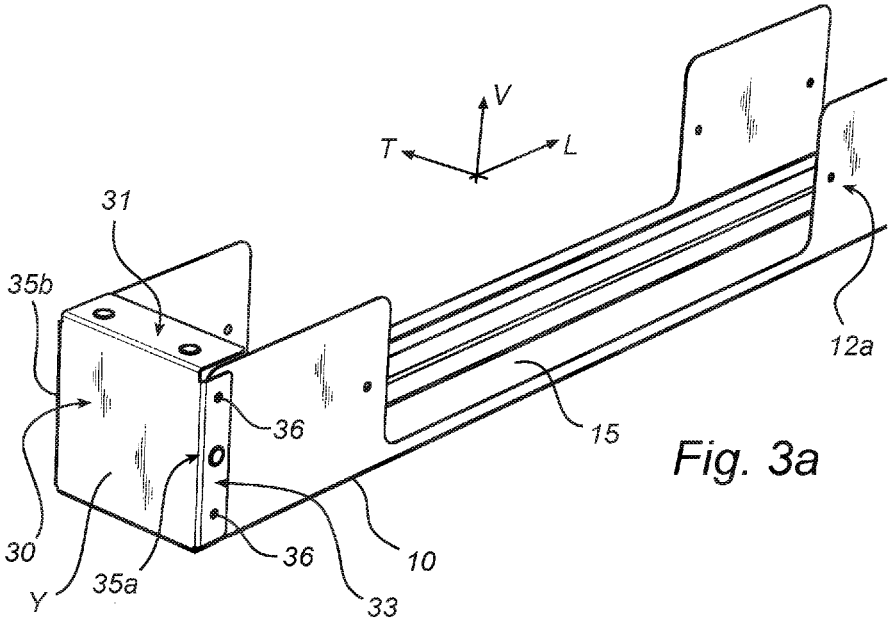
FIG. 3*a* illustrates a part of a main profile with an end element.

It will be appreciated that other shapes of the stiffening profile 20 are also possible within the scope of the present invention. For example, the stiffening profile 20 can be a profile with a cross section in the form of two opposite C-profiles with a common upper surface. The profile can be arranged on the main profile 10 in such a way that the profile is arranged in each side surface of the main profile 10 via the respective side surface of the profile. The upper surface of the stiffening profile then covers the upper opening in the cross section of the main profile 10 in the vertical direction. The stiffening profile then has a cross section like a staple. A stiffening profile of this shape can constitute a top face, as mentioned above, of the main profile 10. In another embodiment of the present invention, the pallet 1 according to FIG. 1 comprises at least one load-transferring end element 30. A main profile 10 together with such an end element 30 is illustrated in FIG. 3*a*.

The end element 30 is arranged in one of the ends of the main profile 10. Preferably, both ends of the main profile 10 are provided with an end element 30.

The end element 30 has an extent in the vertical direction such that the end element 30 may transfer a load from its upper surface to its lower surface. The upper surface of the end element 30 is directly or indirectly connected to the load deck 16 of the pallet 1. The lower surface of the end element 30 is directly or indirectly connected, either to the bottom 11 of the main profile 10 at which the end element 30 is arranged, or to the support on which the pallet 1 is arranged. The support may be e.g. an underlying pallet or the ground.

Different preferred embodiments of the end element 30 which provides the above disclosed load transfer will now be described in detail.

The end element 30 has a surface Y. The surface Y covers one of the longitudinally open ends of the main profile 10. The covering surface Y provides a surface by which the pallet 1 can be pushed. A fully covering surface Y also protects the main profile 10 from damage that can occur, for example, if a fork is accidentally driven in between the side surfaces 12*a*, 12*b* of the main profile 10.

The surface Y can be a plane surface. Alternatively, the surface Y can be a surface that curves in or out in the longitudinal direction.

The end element 30 has an upper surface 31. In this embodiment, the upper surface 31 is formed by an upper tongue that is folded inwards from the surface Y in the longitudinal direction.

The surface Y has two stiffening folds 35*a*, 35*b*. The folds 35*a*, 35*b* extend substantially in the vertical direction V. The folds 35*a*, 35*b* are arranged at a distance from each other in the transverse direction T.

The stiffening folds 35*a*, 35*b* provide a stiff end element that can transfer loads in the vertical direction.

In FIG. 3*a*, the folds 35*a*, 35*b* limit the extent of the surface Y in the transverse direction T. This design creates a side surface 33 on each side of the surface Y in the transverse direction T. Only one of the two side surfaces 33 is shown in FIG. 3*a*. The folds 35*a*, 35*b* each constitute the edge which is formed between the surface Y and each side surface 33 of the end element 30.

In FIG. 3*a*, the side surfaces 33 are in the form of side tongues. The side tongues can be formed by folding the side tongues in from the surface Y.

An end element 30 with folds 35*a*, 35*b*, which constitute edges between the surface Y and each side surface 33, has the advantage of avoiding sharp edges at the sides of the surface Y in the transverse direction T. The corners and each side surface 33 also cover the sharp edge that the side surfaces 12*a*, 12*b* of the main profile 10 may have in the longitudinal direction L. In this way, these edges cannot cause damage to what surrounds them, for example a person's hands, or the parts of a machine handling the pallet. Each side surface 33 therefore affords at least two desired advantages: firstly, stiffening folds are formed between each side surface 33 and the surface Y, and, secondly, each side surface 33 provides greater collision resistance and increases the safety of handling of the pallet. The end element 30 is secured in the main profile 10 by means of securing members 36. For example, the securing members 36 can be rivets, screws or similar members having the same function. The securing members 36 pass through the side surface 33 of the end element 30 and the side surface 12*a* of the main profile 10. The other side tongue of the end element 30 is secured correspondingly on the opposite side surface 12*b* of the main profile 10.

Figure 3B:
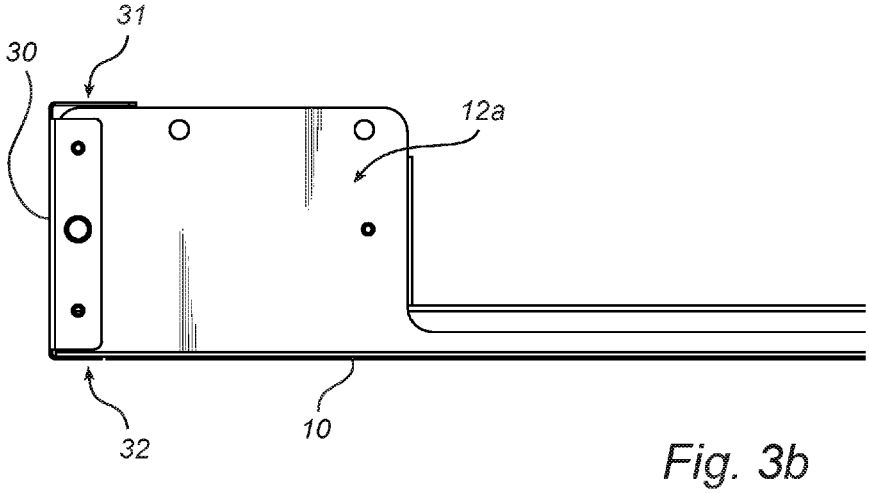
FIG. 3*b* is a side view of the main profile in FIG. 3*a*.

The main profile 10 and the end element 30 are illustrated from the side in FIG. 3*b*. This figure shows that the end element 30 also has a lower surface 32. In this embodiment, the lower surface 32 is formed by a lower tongue.

The lower tongue is exactly like the upper tongue that forms the upper surface 31 and is folded inwards in the longitudinal direction L from the surface Y. The lower surface 32 is arranged under the bottom 11 of the main profile 10 in the vertical direction V. The lower surface 32 thus protects the surrounding area from sharp edges of the end element 30 and of the main profile 10. For example, this avoids sharp edges causing damage to a person's hands or to material loaded underneath.

The end element 30 is preferably made of metal. The thickness of the metal forming the end element 30 preferably lies in the range of 0.4 to 2 millimeters, particularly preferably in the range of 0.8 to 1.5 millimeters. This thickness provides good stiffness for transfer of vertical loads, and also good stiffness for pushing the pallet 1 via the end element 30. Moreover, a metal sheet with a thickness within one of the stated ranges ensures that the above-described tongues forming the side surfaces, upper surface and lower surface of the end element can be formed by means of bending the metal sheet.

The end element 30 described above has one of the preferred embodiments of the present invention. FIGS. 4*a*, 4*b*, 4*c* and 4*d* illustrate alternative embodiments of the end element 30.

Figure 4A:
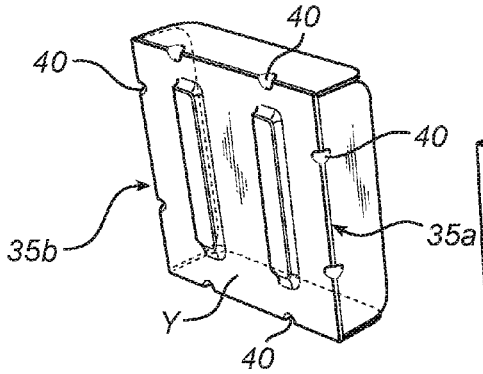
FIGS. 4*a*-4*d* illustrate various embodiments of an end element.

In FIG. 4*a*, the surface Y of the end element 30 is provided with two vertical impressions, i.e. each of the impressions comprises two folds. Moreover, the end element 30 comprises impressions 40 along the corners between the surface Y and the upper surface, lower surface and side surfaces, respectively. The impressions 40 permit further stiffening of the end element 30. In this way, the end element 30 can withstand further loading without being deformed.

Figure 4B:
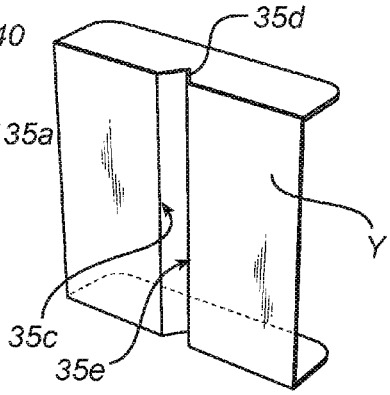

In FIG. 4*b*, the stiffening folds of the end element 30 are in the form of three folds 35*c*, 35*d*, 35*e*. The folds 35*c*, 35*d*, 35*e* in the surface Y form a projection that extends inwards from the surface in the longitudinal direction. The end element 30 in FIG. 4*b* has no side tongue 33.

Figure 4C:
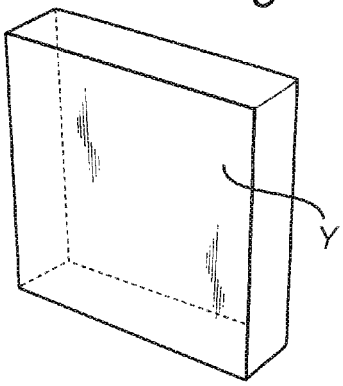

The upper surface, lower surface and side surfaces of the end element 30 in FIG. 4*c* are contiguous and together form an edge directed inwards from the surface Y in the longitudinal direction. An end element 30 with this design can be produced by deep drawing.

Figure 4D:
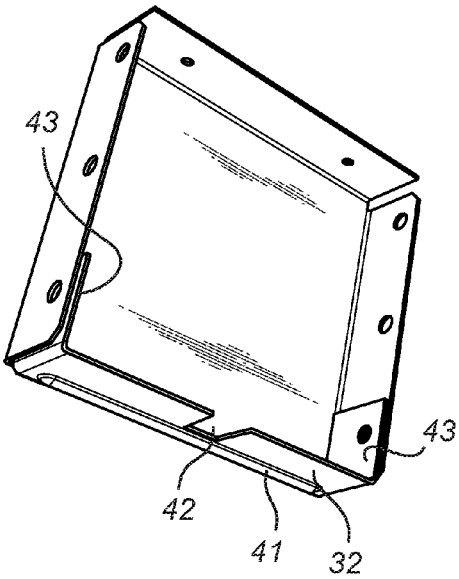

FIG. 4*d* shows an embodiment of the end element 30. The end element 30 has a lower surface 32, which is provided with one or more beads 41. Each bead 41 extends in the transverse direction, and in a downward direction from the lower surface 32 when the pallet is used to bear a load. Note that the end element 30 in FIG. 4*d* is shown obliquely from below, in contrast to FIGS. 4*a* to 4*c*, where it is shown obliquely from above.

At least one of the beads 41 or preferably all of the beads 41 has/have substantially the same height as the thickness of the plate or other material forming the bottom 11 of the main profile 10. The height of the beads 41 is preferably slightly greater compared to the thickness of the plate or other material forming the bottom 11. It is advantageous that the height of at least one of the beads 41 lies in the range of 0.4 to 2 millimeters, particularly advantageously in the range of 0.8 to 1.5 millimeters.

The lower surface 32 of the end element 30 is arranged to extend partially into the main profile 10. The underside of the lower surface 32 is arranged to bear on the upper face of the bottom 11 of the main profile 10. The end element 30 is arranged such that each bead 41 is arranged outside the main profile 10 in the direction towards the surface Y. Another way of saying this is that the end element 30 extends by a certain distance in the longitudinal direction L outside the main profile 10, such that the bead 41 lies outside the main profile 10. In this way, the bead 41 comes to rest directly on the support on which the pallet 1 stands.

Since the end element 30 is provided with at least one bead 41 that has a height substantially the same as or preferably greater than the thickness of the bottom 11, and since the end element 30 is arranged such that the bead or beads 41 are arranged outside the main profile 10, there is less risk of the open edge of the bottom 11 of the main profile 10 causing damage during manual or machine handling of the pallet 1. Since each bead 41 is arranged outside the main profile 10, there is less risk of a user or the base coming into contact with the open edge of the bottom 11 when the pallet 1 is being handled.

The lower surface 32 of the end element 30 has a protrusion 42 which extends from an inner edge of the lower surface 32. The protrusion 42 is arranged to receive the indent 13 of the main profile 10. The protrusion 42 has an extent in the transverse direction, and a depth in the direction of the surface Y of the end element 30. The extent of the protrusion 42 in the transverse direction decreases with the depth of the protrusion 42. In this embodiment, the protrusion 42 has two inclined edges along the inward extent of the protrusion 42, these being arranged such that the protrusion 42 opens towards the indent 13 of the main profile 10.

The smallest extent of the protrusion 42 in the transverse direction, preferably furthest into the protrusion, is adapted to engage with a close fit around the indent 13. In this way, the indent 13 is held by the lower surface 32 of the end element 30, and this increases the stability of the indent 13 and therefore of the main profile 10 and of the pallet 1.

The lower surface 32 of the end element 30 is provided with side surfaces 43 which are folded upwards along the side surfaces 33 of the end element 30. Preferably, the side surfaces 43 of the upper surface are arranged to extend on the inside of the main profile 10.

Preferably, each side surface 43 is also arranged to extend on the inside of the main profile 10 in such a way that the end element 30 can be secured by means of securing members that pass through the side surface 33 of the end element 30, the side surface 12*a* of the main profile 10, and onwards through the side surface 43 of the lower surface. In this way, it is possible to increase the stability of the end element 30 and of the main profile 10, and therefore the overall stability of the pallet 1.

It will be appreciated that other embodiments of the stiffening folds, surfaces, beads and protrusions are possible within the scope of the present invention. For example, it is possible to use combinations of the abovementioned embodiments.

Figure 5:
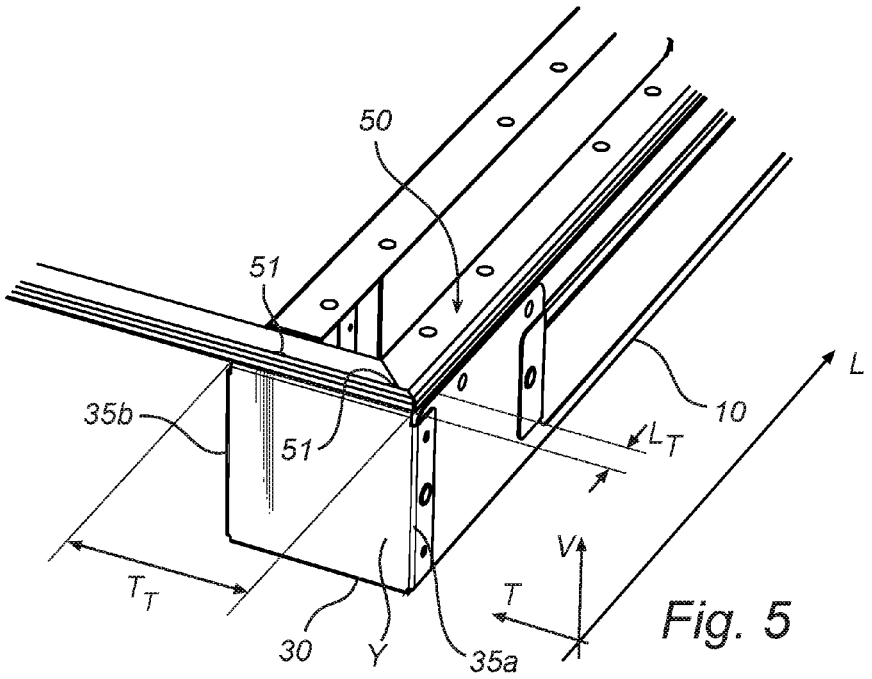
FIG. 5 illustrates a part of a main profile with an end element and a corner-stiffening element.

Moreover, the pallet 1 comprises a corner-stiffening element 50. A main profile 10 according to FIGS. 3*a* and 3*b* which is provided with such a corner-stiffening element 50 is illustrated in FIG. 5. The corner-stiffening element 50 extends substantially in the horizontal plane defined by the longitudinal direction L and the transverse direction T. The corner-stiffening element 50 has an extent such that the corner-stiffening element 50 covers a large part of the extent $L_T$ of the upper tongue 31 in the longitudinal direction L. Moreover, the corner-stiffening element 50 extends beyond the upper tongue 31 in the longitudinal direction L inwards from the surface Y. The corner-stiffening element 50 also covers the extent $T_T$ of the upper surface 31 in the transverse direction.

One of the functions of the corner-stiffening element 50 is to permit transfer of a vertical load to the end element 30. This is made possible by the fact that the corner-stiffening element 50 bears on the upper surface 31 of the end element 30. By means of the upper surface 31 and the stiffening folds 35*a*, 35*b*, the end element 30 ensures that the vertical load received from the corner-stiffening element 50 can be transferred to the bottom 11 of the main profile 10. Alternatively, the vertical load can be transferred to a support on which the pallet 1 is designed to be placed.

By virtue of the fact that the end element 30 takes up weight from the load deck 16, the main profile 10 is subject to less loading. The pallet 1 is thus able to withstand greater loads without the main profiles 10 deforming. This property is particularly advantageous when the pallet 1 is surmounted by means of a pallet collar. In this case, much of the weight on the side surfaces 12*a*, 12*b* of the main profiles 10 is the weight from the pallet collar. Since this weight is instead taken up by the end element 30, the main profiles 10 are subject to much less loading. The pallet 1 preferably comprises a plurality of end elements 30.

The greater the contact surface between the corner-stiffening element 50 and the upper surface 31 of the end element 30, the greater the load that can be transferred. This property means that the main profile 10 is subjected to even less loading. In this way, the pallet 1 can be more heavily loaded, especially with a pallet collar, without the risk of deformation of the main profile 10.

Since the corner-stiffening element 50 extends beyond the extent of the upper surface 31 in the longitudinal direction L and/or transverse direction T, further stiffening of the construction is obtained. This has, among other things, the advantage that the upper surface 31 is not so easily bent downwards in the vertical direction when subjected to a weight from the corner-stiffening element 50. Instead, the weight is distributed across a greater surface area of the corner-stiffening element 50, rather than constituting a more punctiform loading of the upper surface 31.

The corner-stiffening element 50 is preferably made of metal. The corner-stiffening element 50 is advantageously a profile with an upwardly directed groove. The profile is made of metal and has a material thickness of 0.4 to 2 millimeters, preferably of 0.8 to 1.5 millimeters.

An example of an alternative embodiment is one in which the corner-stiffening element 50 is formed by a plate having substantially the shape of a right-angled triangle. The right-angled corner of the triangle is then arranged at the right-angled corner formed by the side surface 12*a* of the main profile and by the upper surface 31 of the end element 30.

The corner-stiffening element 50 is secured in the upper surface 31 of the end element 30 by means of securing members 51. The securing members 51 can be in the form of rivets, screws or other suitable members having a similar function. By means of the securing between the corner-stiffening element 50 and the upper surface 31, the structure of the pallet 1 is stiffened in relation to forces directed in the longitudinal direction L. This property stems from the fact that, by virtue of the securing, the main profile 10 is not uncoupled from the corner-stiffening element 50.

As a result of this further stiffening, the pallet 1 is able to better withstand transport and handling. For example, much greater forces are needed to move the pallet in a swaying motion in the longitudinal direction L, because the corner-stiffening element 50 is secured in the upper tongue 31.

The corner-stiffening element 50 can form at least part of a frame element for the pallet 1. The frame element preferably runs around the periphery of the pallet 1 in a horizontal plane.

The frame element can be formed with a groove. The groove is designed in such a way that a pallet collar can be arranged in the groove. Since the pallet collar can be arranged in the groove, there is no need for an external add-on part to permit the arrangement of a pallet collar. A commonly occurring add-on part of this kind is a stop edge. Further loading volume can thus be freed up, and it is possible to cut down on the amount of material used, since the add-on part is replaced by the frame element with its groove.

An alternative design of a pallet 1 is without corner-stiffening element 50. In such a design, a pallet collar can lie directly connected to the upper surface 31 of the end element 30.

Figure 6A:
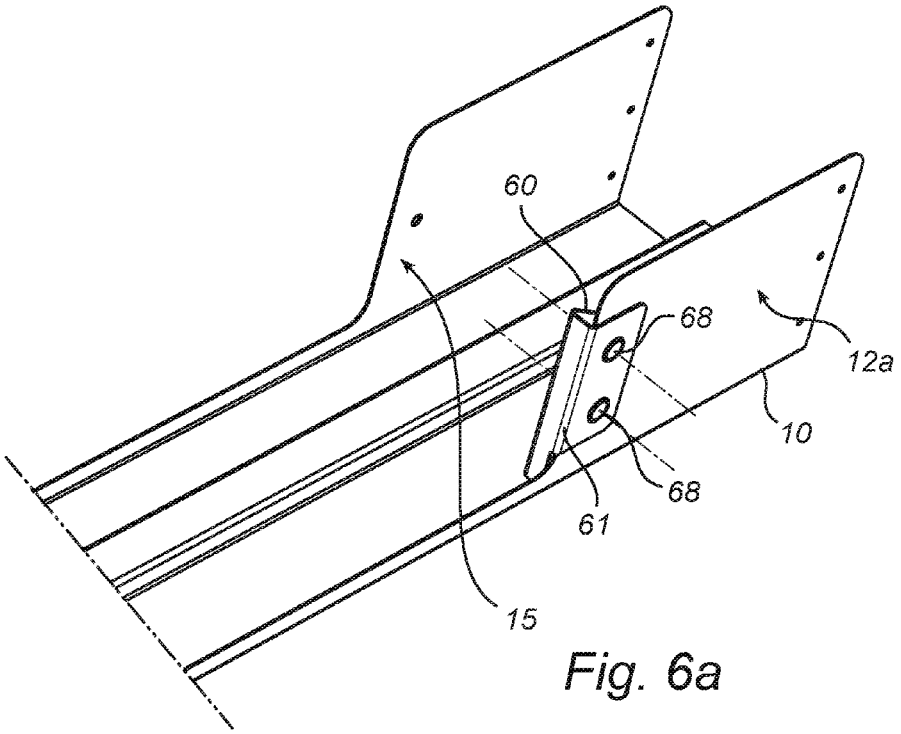
FIG. 6*a* illustrates a part of a main profile which has a stiffening element.

In a third embodiment of the present invention, the pallet 1 according to FIG. 1 comprises a load-transferring stiffening element 60. A main profile 10 with such a stiffening element 60 is illustrated in FIG. 6*a*.

The stiffening element 60 is arranged at an edge of the opening 15 of the main profile 10. The edge extends substantially in the vertical direction V.

The stiffening element 60 is designed such that a stiffening fold is created. The stiffening fold allows a vertical load to be transferred by means of the stiffening element 60. The vertical load can consist of the weight on the pallet 1, especially on the horizontal load deck 16 thereof. In order to take up the vertical load, the stiffening element 60 is connected directly or indirectly to the load deck 16.

Figure 6B:
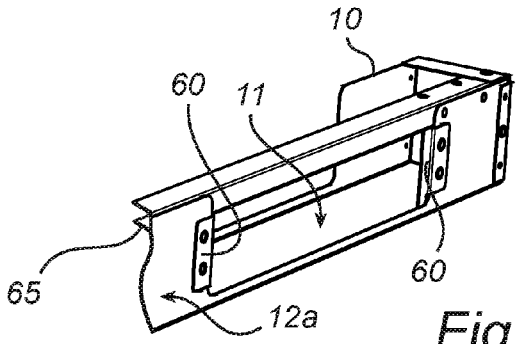
FIG. 6*b* illustrates a part of a main profile which has a load-transferring element and a stiffening profile.

An indirect connection between the stiffening element 60 and the load deck 16 can be obtained by means of an upper load-guiding element 65, which is illustrated in FIG. 6*b*. The upper load-guiding element 65 can have a design and function like the stiffening profile 20 in an embodiment described earlier. The stiffening element 60 is arranged in contact with a lower surface of the upper load-guiding element 65, in such a way that a vertical load can be transferred from the upper load-guiding element 65 to the stiffening element 60.

Figure 6C:
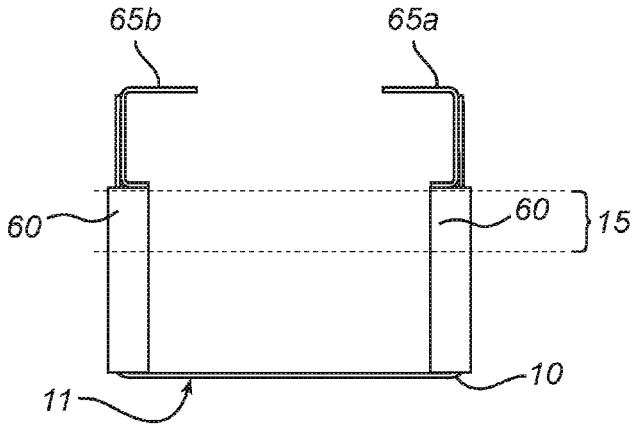
FIG. 6*c* is a cross section of a main profile with stiffening element and upper load-transferring element.

The stiffening element 60 is also arranged in direct contact with the bottom 11 of the main profile 10, as illustrated in FIG. 6*c*. In this way, a vertical load that is received is transferred directly to the bottom 11.

Since the stiffening element 60 takes up the vertical load, the main profile 10 is subjected to less loading, especially the side surface 12*a* thereof. This is especially advantageous when the load deck 16 of the pallet 1 is loaded with an uneven or unbalanced load.

An uneven or unbalanced load is, for example, a load that bears on certain parts of the load deck 16 more than on others. The weight is then taken up to a lesser extent by the stiffer end parts of the main profile 10 compared to when the load deck 16 is loaded with a load that is uniform and balanced across the whole of the load deck 16.

An uneven or unbalanced load can, for example, be a load concentrated in one point at the part of the main profile 10 where the opening 15 is arranged. Such a load can cause the main profile 10 to sag in the vertical direction V.

A stiffening element 60 arranged as described above reduces the load applied to the central part of the main profile 10 as seen in the longitudinal direction. The pallet 1 is thus able to manage more uneven and unbalanced loads compared to a pallet without a stiffening element 60.

In an alternative design of the stiffening element 60, a vertical load that is received is transferred indirectly to the bottom 11. Lower load-guiding elements may in such an embodiment be arranged in contact with a respective stiffening element 60 and with the bottom 11 of the main profile 10.

The stiffening element 60 according to the present invention can thus be designed in a number of different ways. What is common to all the designs is that the stiffening element 60, on the one hand, comprises at least one stiffening fold and, on the other hand, has a vertical extent such that the stiffening element 60 can transfer a vertical load from the load deck 16 to the bottom 11 of the main profile 10.

Figure 7:
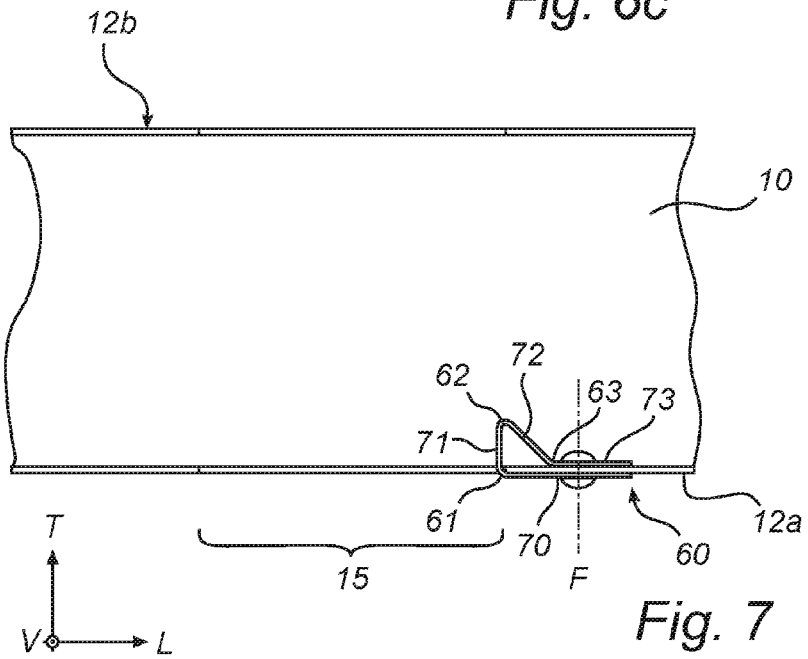
FIG. 7 is a top view of a part of a main profile with a stiffening element.

FIG. 7 illustrates a preferred embodiment of the stiffening element 60. The figure is a top view of a main profile 10 with a stiffening element 60.

The stiffening element 60 comprises three stiffening folds 61, 62, 63. The stiffening folds 61, 62, 63 extend in the vertical direction V.

The stiffening element 60 comprises four surfaces 70, 71, 72, 73. Two of the folds 61, 62 are separated in the transverse direction. Two of the folds 61, 63 are separated in the longitudinal direction. These properties together provide good stiffening of the stiffening element 60.

Two of the surfaces 70, 73, which form two non-adjacent and outer surfaces of the stiffening element 60, are arranged parallel to each other. Moreover, the surfaces 70, 73 are arranged, in the transverse direction T, on a respective side of the side surface 12*a* of the main profile 10.

In this way, that part of the side surface 12*a* that forms the edge of the opening 15 is protected against effects both from the outside and from the inside of the main profile 10. These effects can include, for example, a fork being driven against the side surface 12*a*. This can happen either from the outside of the main profile 10 or from the inside, when the fork is driven in through an opening on the opposite side surface 12*b*.

The stiffening element 60 is secured in the side surface 12*a* of the main profile 10. This is achieved by means of one or more securing elements which are placed through the side surface 12*a* and the two parallel surfaces 70, 73, along a securing line F.

The fact that the stiffening element 60 is secured through both surfaces 70 and 73 results in a high degree of stiffening. This is a preferred embodiment. It will be appreciated, however, that the stiffening element 60 can also be secured in another way within the scope of the present invention.

In this embodiment, the stiffening element 60 thus has a plurality of stiffening folds 61, 62, 63. However, it is not necessary for the stiffening element 60 to comprise more than one stiffening fold in order to reduce the loading and provide protection. Preferably, said at least one fold is arranged as the stiffening fold indicated by 61 in FIG. 7.

Moreover, in the embodiment described, the stiffening element 60 has four surfaces 70, 71, 72, 73. However, it is not necessary for the stiffening element 60 to comprise more than two such surfaces. These surfaces are preferably arranged as the surfaces indicated by 70 and 71 in FIG. 7. In another embodiment of the present invention, the pallet 1 comprises basically the same parts as have been described in the previous embodiments. This means that the pallet 1 comprises at least one stiffening profile 20, at least one end element 30 and at least one stiffening element 60. A pallet 1 according to this embodiment withstands a greater load, as compared to known pallets made of metal, when it is loaded in a pallet stand, when it is loaded on the ground, when it is lifted, and also when it is loaded with an uneven or unbalanced load.

In summary, according to a preferred embodiment the pallet comprises at least two elongate main profiles 10 which extend along a longitudinal direction L, are connected to each other and are located at a distance from each other in a transverse direction T; wherein the longitudinal direction L and the transverse direction T define a horizontal plane; wherein the main profiles have a substantially U-shaped cross section which comprises a bottom 11 and two side surfaces 12*a*, 12*b* extending from the bottom; wherein the main profiles are oriented such that the side surfaces extend substantially upwards from the bottom 11, substantially along a vertical direction V which is perpendicular to the horizontal plane; wherein the main profiles are each provided with through-openings through both side surfaces 12*a*, 12*b* in order to form a channel which extends through said at least two main profiles and permits introduction of a fork; and wherein each opening has an extent in the longitudinal direction L and an extent in the vertical direction V. In one embodiment, the pallet further comprises at least one elongate stiffening profile 20 extending along the longitudinal direction L; wherein said at least one stiffening profile 20 is in each case secured in one of the side surfaces 12*a*, 12*b* of a respective main profile 10; wherein said at least one stiffening profile 20 extends in each case in the longitudinal direction L across the extent of at least one opening in the longitudinal direction L and past said at least one opening on both sides of said at least one opening; and wherein each stiffening profile 20 is arranged in the vertical direction V above the channel.

Figure 8A:
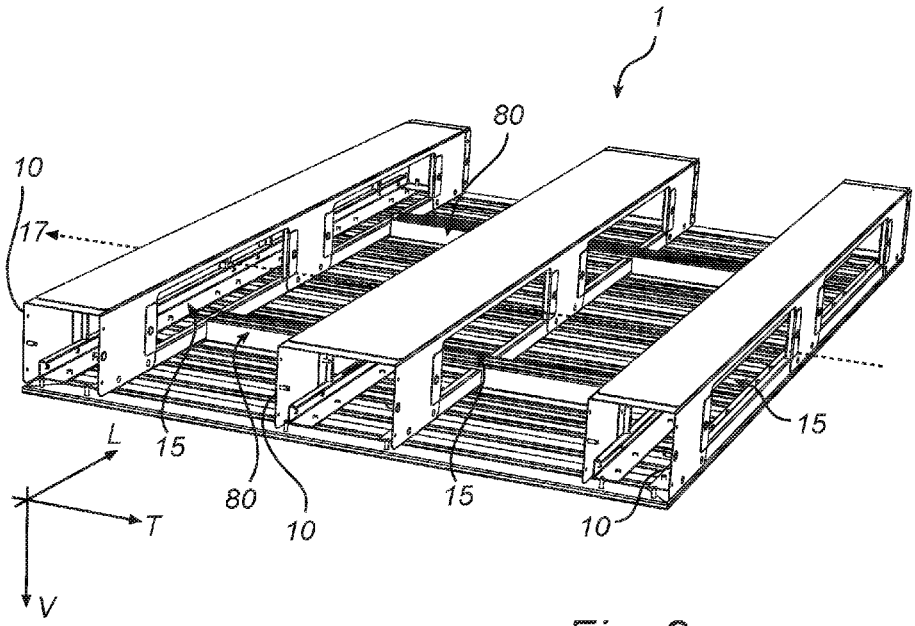
FIG. 8*a* illustrates a pallet with a filler profile.
Figure 8B:
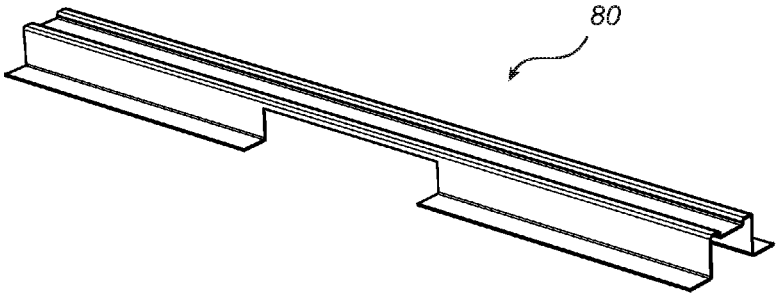
FIG. 8*b* illustrates a filler profile.

FIGS. 8*a* and 8*b* show a pallet with a filler profile 80. In order to secure loads on the pallet 1, it is possible to use a load-anchoring element, such as a flexible strap, rope, cord or band, which is intended to run round the pallet and round the load arranged on the pallet 1. The load-anchoring element can be passed via through-openings in both side surfaces of the main profiles 10. These openings can be the same openings as the ones intended for insertion of a fork of a fork-lift truck, or special openings for forming a channel 17 which extends through both main profiles and which allows a load-anchoring element to be passed through.

Each opening has, in the vertical direction V, an upper geometric limit (the opening edge) which, in the vertical direction V, is situated below and at a distance from an underside of a load deck of the pallet.

An example of such an embodiment is if the main profiles 10 are provided with longitudinal stiffening profiles of the type that has been described above. The longitudinal stiffening profiles extend along the underside of the load deck of the pallet 1. Since it is desirable that the stiffening profiles extend in the longitudinal direction past the openings, the stiffening profiles come to force the upper geometric limit of the openings downwards from the underside of the load deck.

The filler profile 80 extends along the underside of the load deck. In addition, the filler profile 80 extends along the channel 17 and, in the transverse direction T, has an extent that substantially extends between the main profiles 10.

According to one embodiment, the filler profile 80 has a height (i.e. extent in the vertical direction V) substantially corresponding to the distance between the underside of the load deck and the upper geometric limit of each opening. Preferably, the filler profile 80 is in direct or indirect contact with the underside of the load deck along a substantial part of the extension of the filler profile 80 in the transverse direction T.

According to one embodiment, the filler profile 80 has a height, i.e. extent in the vertical direction V, which is greater than the distance between the underside of the load deck and the upper geometric limit och each opening. Preferably, the filler profile 80 extends slightly beyond the upper geometric limit in the vertical direction V. By this feature, a load-anchoring element or a fork which is inserted in the channel 17 comes in contact with the filler profile 80 instead of the edge of the opening, i.e. the upper geometric limit. Thus, the edge, being a part of the side surface of the main profile, is not subjected to any loads and is protected from being damages due to such loads.

When the pallet 1 is lifted by a fork inserted in the channels 17 and being in contact with the filler profile 80, the filler profile 80 also functions as a load-transferring profile. Instead of subjecting the edges of the through-openings to the vertical loads, the vertical loads are transferred from the load deck to the fork at least partly through the filler profile 80. Preferably, the filler profile 80 is in direct or indirect contact with the underside of the load deck along a substantial part of the extension of the filler profile 80 in the transverse direction T. Thus, by the filler profile 80, the side surfaces of the main profile becomes relieved from load which lowers the risk of damaging the side surfaces of main profiles 10.

According to one embodiment, the pallet is provided with three longitudinal main profiles, namely two outer ones and a central one, in which case the filler profile extends across from one of the outer main profiles to the other of the outer main profiles.

In such a variant, it is advantageous if the filler profile is provided with a central recess, such that it can bridge the stiffening profiles of the central main profile. This central recess is shown in FIG. 8*b*.

The central recess is open towards the underside of the load deck of the pallet, with the result that, at a distance from the underside of the load deck, there is a continuous transverse extent of the filler profile which bridges the stiffening profiles of the central main profile.

The filler profile is designed as a U-profile which, seen in cross section, is provided with substantially horizontal flanges extending outwards from the ends of the legs. The filler profile can be secured to the underside of the load deck of the pallet by, for example, riveting the flanges to the underside of the load deck.

The filler profile is additionally provided with a groove which extends along the filler profile and which, in the cross section of the filler profile, is designed as an impression in a central part of the bottom of the U-profile, in the same direction as the legs. This means that the U-profile is made stiffer, and the groove also comes to guide and protect the flexible load-anchoring element.

According to one embodiment of the invention, the pallet 1 comprises at least two elongate main profiles 10 which extend along a longitudinal direction L, are connected to each other and are located at a distance from each other in a transverse direction T, wherein the longitudinal direction and the transverse direction define a horizontal plane, wherein each main profile has a cross section which comprises a bottom 11 and two side surfaces 12*a*, 12*b* extending from the bottom, wherein the main profiles are oriented such that the side surfaces extend substantially upwards from the bottom, substantially along a vertical direction V which is perpendicular to the horizontal plane, wherein the main profiles are each provided with through-openings 15 through both side surfaces in order to form a channel 17 which extends through said at least two main profiles and permits introduction of a fork, and wherein each opening has an extent in the longitudinal direction and an extent in the vertical direction, the pallet 1 being characterized in that the pallet further comprises at least one elongate stiffening profile 20 extending along the longitudinal direction, said at least one stiffening profile is in each case secured in one of the side surfaces of a respective main profile, said at least one stiffening profile extends in each case in the longitudinal direction across the extent of at least one opening in the longitudinal direction and past said at least one opening on both sides of said at least one opening, and each stiffening profile is arranged in the vertical direction above the channel.

According to one embodiment of the invention, the pallet 1 comprises at least two elongate main profiles 10 which extend along a longitudinal direction L, are connected to each other and are located at a distance from each other in a transverse direction T, wherein the longitudinal direction and the transverse direction define a horizontal plane, wherein the main profiles have a cross section which comprises a bottom 11 and two side surfaces 12*a*, 12*b* extending from the bottom, and wherein the main profiles are oriented such that the side surfaces extend substantially upwards from the bottom, substantially along a vertical direction V which is perpendicular to the horizontal plane, the pallet 1 being characterized in that the pallet further comprises a load-transferring end element 30, the end element has a surface Y which at least partially covers an end, open in the longitudinal direction, of one of the main profiles, the end element has at least two vertically extending stiffening folds 35*a*, 35*b*, 35*c*, 35*d*, 35*e* arranged at a distance from one another in the transverse direction, the end element has an upper surface 31 that extends in the longitudinal direction inwards from the surface, and the end element has a vertical extent such that the end element can transfer a vertical load from the upper surface to the bottom of the main profile or to the support on which the pallet is designed to be placed.

According to one embodiment of the invention, the pallet 1 comprises at least two elongate main profiles 10 which extend along a longitudinal direction L, are connected to each other and are located at a distance from each other in a transverse direction T, wherein the longitudinal direction and the transverse direction define a horizontal plane, wherein the main profiles have a cross section which comprises a bottom 11 and two side surfaces 12*a*, 12*b* extending from the bottom, wherein the main profiles are oriented such that the side surfaces extend substantially upwards from the bottom, substantially along a vertical direction V which is perpendicular to the horizontal plane, wherein the main profiles are each provided with through-openings 15 through both side surfaces in order to form a channel 17 which extends through both main profiles and permits introduction of a fork, and wherein each opening has an extent in the longitudinal direction and in the vertical direction, the pallet 1 being characterized in that the pallet further comprises a load-transferring stiffening element 60, the load-transferring stiffening element has at least one vertically extending stiffening fold 61, 62, 63, the stiffening fold extends in direct proximity to and along a vertically extending edge of one of the openings, and the stiffening element has a vertical extent such that the stiffening element can transfer a vertical load directly or indirectly from a horizontal load deck 16 directly or indirectly to the bottom of the main profile.

According to one embodiment of the invention, the pallet 1 comprising at least two elongate main profiles 10 which extend along a longitudinal direction L, are connected to each other and are located at a distance from each other in a transverse direction T, wherein the longitudinal direction and the transverse direction define a horizontal plane, wherein the main profiles are each provided with through-openings 15 through both side surfaces in order to form a channel 17 which extends through both main profiles and permits introduction of a load-anchoring element, such as a flexible strap, rope, cord or band, intended to run round the pallet and the load arranged on the pallet, the pallet 1 being characterized in that each opening has, in the vertical direction, an upper geometric limit which, in the vertical direction, is situated below and at a distance from an underside of a load deck of the pallet, the pallet further comprises a filler profile which extends along the underside of the load deck, the filler profile extends along the channel and, in the transverse direction, has an extent that substantially extends between the main profiles, and the filler profile has, in the vertical direction, an extent substantially corresponding to the distance between the underside of the load deck and the upper geometric limit of each opening.

The invention claimed is:

1. A pallet comprising:

at least two stringers in the form of elongate main profiles which extend along a longitudinal direction, which are connected to each other and which are located at a distance from each other in a transverse direction, wherein the longitudinal direction and the transverse direction define a horizontal plane, wherein each main profile has a cross section which comprises a bottom and two side surfaces extending from the bottom, wherein the main profiles are oriented such that the side surfaces extend substantially upwards from the bottom, substantially along a vertical direction which is perpendicular to the horizontal plane, wherein the main profiles are each provided with through-openings through both side surfaces, wherein each opening has an extent in the longitudinal direction and an extent in the vertical direction, wherein said openings are arranged at corresponding same positions on all of the side surfaces so that at least one channel which extends through said at least two main profiles is created in order to permit introduction of a fork, said pallet further comprising at least one elongate stiffening profile extending along the longitudinal direction, wherein said at least one stiffening profile is in each case secured in one of the side surfaces of a respective main profile, wherein said at least one stiffening profile extends in each case, in view of the longitudinal direction, across the extent of at least one opening in the longitudinal direction and past said at least one opening on both sides of said at least one opening, wherein each stiffening profile is arranged, in view of the vertical direction, above the channel; and wherein each stiffening profile partially covers each opening.

2. The pallet according to claim 1, wherein each stiffening profile has, in view of the vertical direction, a lower contact surface facing the channel in order to permit contact of a fork.

3. The pallet according to claim 1, wherein the openings are open upwards in view of the vertical direction.

4. The pallet according to claim 1, wherein the bottom of each main profile has one or more indents.

5. The pallet according to claim 1, comprising one stiffening profile per side surface of each main profile.

6. The pallet according to claim 1, wherein the stiffening profiles have a substantially C-shaped cross section.

7. The pallet according to claim 1, wherein the number of main profiles is at least three.

8. The pallet according to claim 1, further comprising a substantially horizontal load deck arranged in direct or indirect contact with the main profiles and above the latter in view of the vertical direction.

9. The pallet according to claim 1, wherein at least the main profiles are made of metal.

10. The pallet according to claim 9, wherein the main profiles comprise high-strength thin metal plate.

11. The pallet according to claim 1, wherein each main profile is arranged such that a tunnel which is formed in the longitudinal direction between two main profiles has a height of 85-160 millimeters.

12. The pallet according to claim 1, further comprising a load-transferring end element, wherein the end element:

has a surface which at least partially covers an end, open in view of the longitudinal direction, of one of the main profiles, has at least two vertically extending stiffening folds arranged at a distance from one another in the transverse direction, has an upper surface that extends in the longitudinal direction inwards from the surface and towards said one of the main profiles, and has a vertical extent such that the end element may transfer a vertical load from the upper surface of the end element to the bottom of the main profile or to the support on which the pallet is designed to be placed.

13. The pallet according to claim 1, further comprising a load-transferring stiffening element:

wherein the load-transferring stiffening element has at least one vertically extending stiffening fold, wherein the stiffening fold extends in direct proximity to and along a vertically extending edge of one of the openings, and wherein the stiffening element in view of the vertical direction is connected directly or indirectly to a horizontal load deck and that the stiffening element is connected directly or indirectly to the bottom of the main profile, such that the stiffening element may transfer a vertical load directly or indirectly from the horizontal load deck directly or indirectly to the bottom of the main profile.

14. The pallet according to claim 1:

wherein said openings are arranged at corresponding same positions on all of the side surfaces so that at least one channel which extends through said at least two main profiles is created in order to permit introduction of a load anchoring element, intended to run round the pallet and the load arranged on the pallet, wherein each opening has, in view of a vertical direction, an upper geometric limit which, in view of the vertical direction, is situated below and at a distance from an underside of a load deck of the pallet, said pallet further comprising a filler profile which extends along the underside of the load deck, wherein the filler profile extends along the channel and, in the transverse direction, has an extent that substantially extends between the main profiles, and wherein the filler profile has, in the vertical direction, an extent substantially corresponding to the distance between the underside of the load deck and the upper geometric limit of each opening.

* * * * *